US006137387A

United States Patent [19]

Van Zeeland

[11] Patent Number: 6,137,387

[45] Date of Patent: Oct. 24, 2000

[54] MAGNETICALLY-RETAINED ARMATURE RETAINER FOR ELECTRICAL SWITCHES

[75] Inventor: Anthony J. Van Zeeland, Mesa, Ariz.

[73] Assignee: DuraSwitch Industries, Inc., Mesa, Ariz.

[21] Appl. No.: 09/480,606

[22] Filed: Jan. 10, 2000

[51] Int. Cl.[7] ..... H01H 9/00

[52] U.S. Cl. ..... 335/205; 335/177; 335/207

[58] Field of Search ..... 335/177–179, 335/205–208

[56] References Cited

U.S. PATENT DOCUMENTS 5,523,730 6/1996 Van Zeeland ..... 335/205

5,666,096 9/1997 Van Zeeland ..... 335/4

*Primary Examiner*—Lincoln Donovan

*Assistant Examiner*—Raymond Barrera

*Attorney, Agent, or Firm*—McEachran, Jambor, Keating, Bock & Kurtz

[57] ABSTRACT

An armature retainer for a magnetic switch retains an armature adjacent an internal surface of a carrier sheet with electrodes thereon forming switch contacts. The retainer includes a polishing pad, a backing layer and openings for the armature to reside therein. Both the armature and the retainer are adhered to the carrier surface by a magnet attraction. One or more magnets are carried in a rotor mounted on the external side of the carrier surface for rotary, linear or complex motion. When a user manipulates a knob attached to the rotor, the magnets rotate the armature and the armature retainer. The polishing pad cleans particles from the carrier surface as the retainer rotates. A shaft receiving opening may be used to tend to keep the armature retainer centered. Grooves embedded in the polishing pad surface are used to collect larger deposits.

16 Claims, 7 Drawing Sheets

MAGNETICALLY-RETAINED ARMATURE RETAINER FOR ELECTRICAL SWITCHES

BACKGROUND OF THE INVENTION

Magnetically actuated switches provide a compact, reliable and durable switching function. These switches offer a very slim profile, low weight and economical assembly. They combine the best features of mechanical and membrane switches. Particularly, they provide the tactile feel of a mechanical switch but with the superior durability of a conventional membrane switch. Without tactile feedback, consumers are not sure if they have activated the switch. Magnetically actuated switches provide the user with a switching sensation to indicate when the switch has been actuated while still providing the compactness of a membrane switch.

Magnetically actuated switches have the further capability of rotary, linear, or complex movement. As such, these switches have a nearly endless range of applications. However, the applicability of the magnetic switch can be expanded still further if the switches can be adapted to withstand high acceleration applications. For example, a switch undergoes abnormal acceleration when exposed to certain unintended activities such as being dropped. Planned activities such as rocket launches, subsonic aircraft flights and automobile accelerations can also subject switches to high loads.

A potential problem of magnetically actuated switches, particularly rotary switches, is that sudden accelerations may dislodge the magnetic bond within the switch. Unless the bond can be reestablished, the switch fails to work. So there is a need to provide a switch which will withstand high acceleration applications and maintain the magnetic attraction between the switch's internal components.

Another problem with magnetically actuated switches, as with membrane switches, is the presence of dust and debris within the switch. The debris may enter during manufacture of the switch or, alternatively, during normal wear of the switch. This debris may interfere with the switch contacts and may result in unpredictable switch performance. Hence, there is also a need to minimize the effect of debris on switch performance.

SUMMARY OF THE INVENTION

The present invention relates to an armature retainer within a magnetically actuated switch that permits the switch to resist displacement of its internal components which might otherwise occur during high acceleration. The present invention also prevents switch failure or unpredictability due to dust or debris on the switch's electrical contacts.

Switches of the type of the present invention have been generally described in U.S. Pat. Nos. 5,523,730, 5,666,096 and 5,867,082. Although the invention is applicable primarily to rotary switches, it will be realized that the armature retainer may also be utilized in switches using linear and complex motion. A rotary switch generally includes a knob mounted, for rotation on a carrier sheet, one or more magnets located within the knob adjacent the carrier, and an armature. The carrier surface opposite the magnets has at least one set of spaced electrical contacts with the armature located on or adjacent the contacts. The armature is made of magnetic material which is electrically conductive. By "magnetic material" it is meant that the material is affected by a magnet. The armature connects the spaced electrical contacts when rotated by a magnet within the knob. For the present invention, it is preferred that the armature be spherical or disc-shaped.

The present invention provides for an armature retainer for the magnetically actuated switch as described. The armature retainer holds the armature adjacent the carrier surface. The retainer is generally disc-shaped with a predetermined thickness. The retainer defines one or more armature pockets. The pockets receive the armature and maintain the position of the armature immediately adjacent the carrier surface and the electrodes. A magnetic attraction between the retainer and one or more magnets within the knob holds the retainer against the carrier surface. As the knob rotates, so do both the retainer and armature. Forces tending to disturb the magnetic attraction between the magnet and the armature are resisted by the armature retainer which will remain fixed and hold the armature in a position adjacent the carrier surface. After the period of sudden acceleration has ended, the magnetic bond between the armature and the magnet will be maintained.

The present invention also comprises an armature retainer which is a lamination formed of a polishing pad and a backing layer. The polishing pad is located adjacent the carrier surface and the electrodes thereon. The pad cleans dust and debris from the electrical contacts and the armature during rotation of the switch. The backing layer is located adjacent the polishing pad opposite the carrier surface. The backing layer is made of magnetic material which is attracted by one or more magnets within the knob. The magnetic attraction between the backing layer and the magnet holds the armature retainer adjacent the carrier surface.

A primary purpose of the invention is to provide a magnetically actuated switch with resistance to high acceleration applications.

Another purpose of the invention is to provide a magnetically actuated switch with resistance to deposits of dust and debris.

Another purpose of the invention is to provide an armature retainer which cleans dust or debris from the electrical contacts during switch use.

A further purpose of the invention is to provide a switch which is resistant to dust and debris when lubrication is applied.

Other purposes will appear in the ensuing specification, drawings and claims.

DETAILED DESCRIPTION OF THE INVENTION

Figure 1:
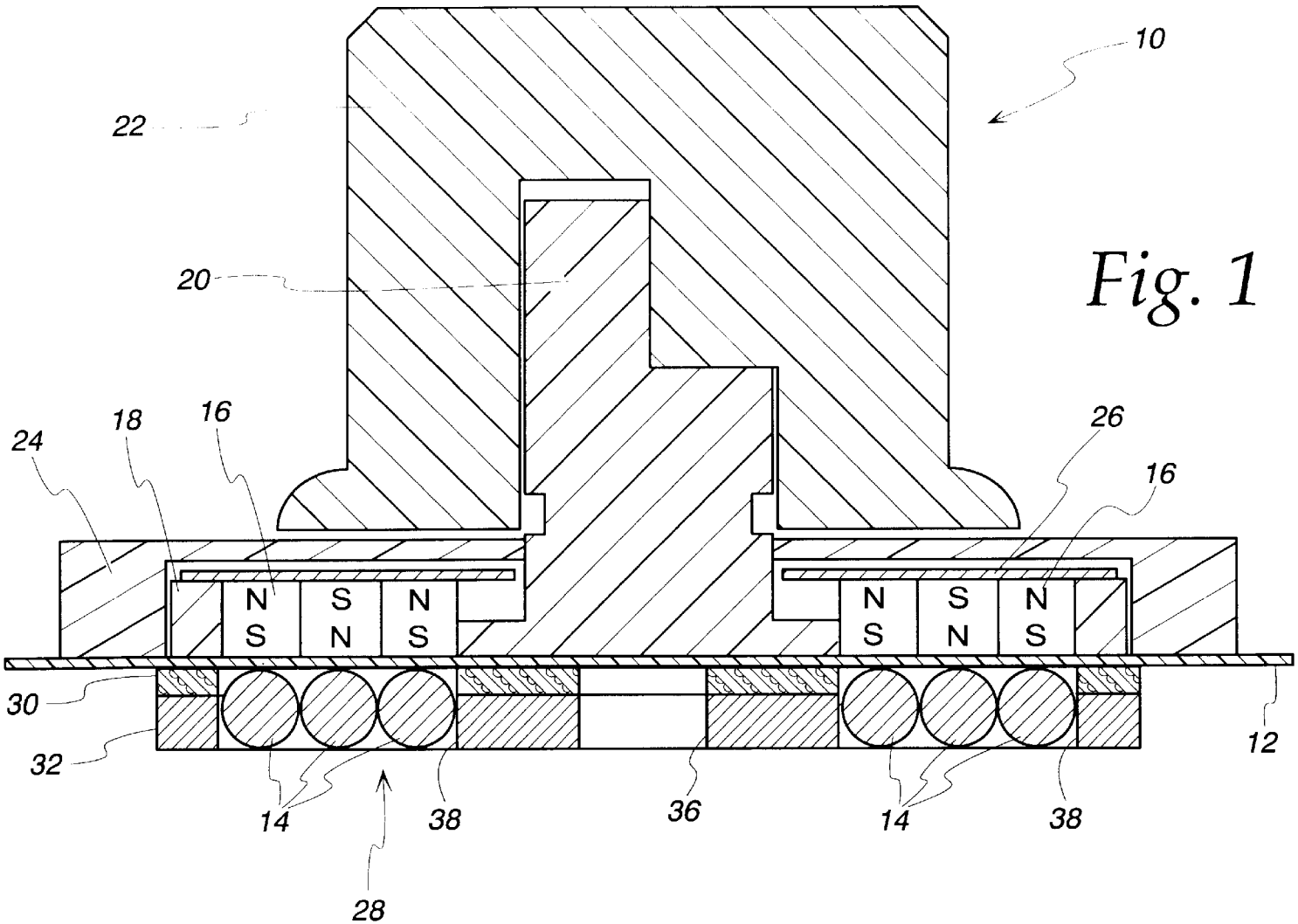
FIG. 1 is a section through a rotary switch with an armature retainer according to the present invention.
Figure 3:
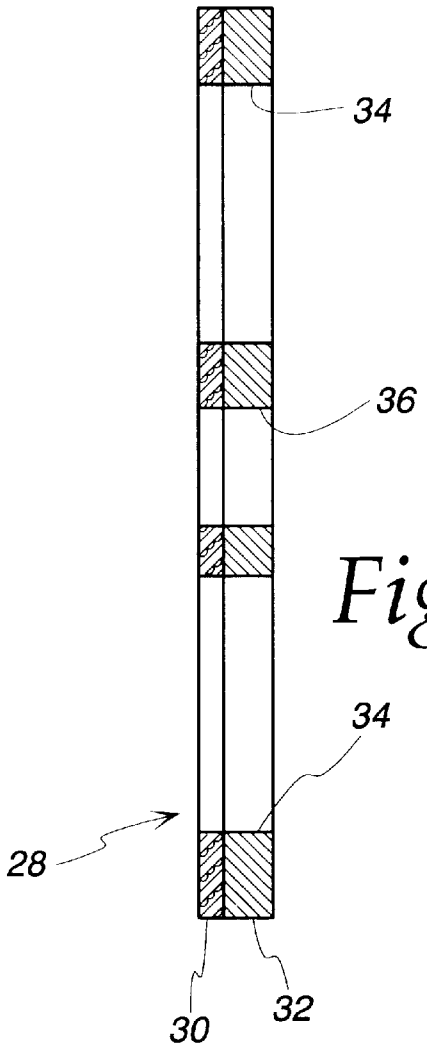
FIG. 3 is a section taken along line 3—3 of FIG. 2.
Figure 2:
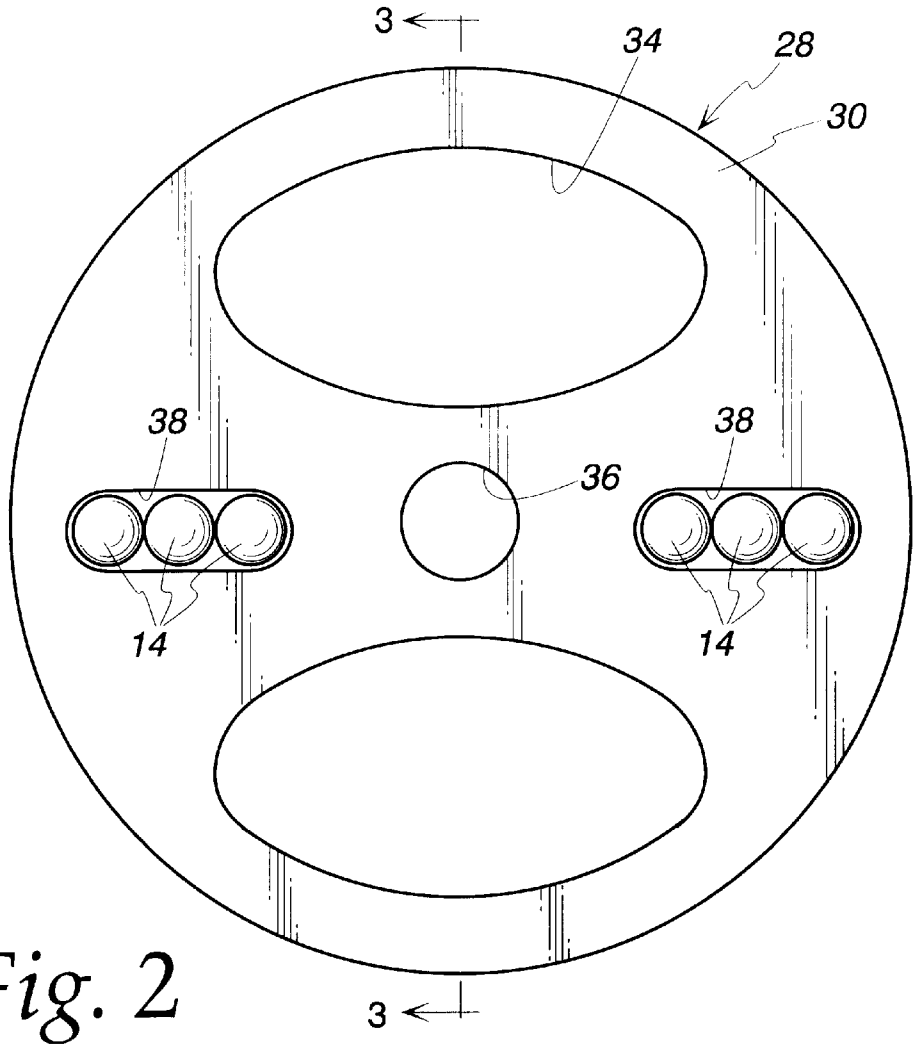
FIG. 2 is a plan view of the armature retainer in FIG. 1.

FIGS. 1, 2 and 3 illustrate a switch having the armature retainer of the present invention. The particular embodiment shown is a rotary switch 10 but the invention may also be used in linear and complex motion switches. The switch includes a carrier 12 in the form of a membrane layer. Although not shown, it will be understood that the underside of the carrier has a set of electrodes which define the spaced contacts of at least one electrical switch or a resistive element and take-off of a potentiometer. Electrically conductive, triple-ball armatures 14 ride on the underside of the carrier 12 for movement relative to the set of electrodes. The armatures move either relative to the potentiometer elements or into and out of shorting engagement with the electrode contacts. Each armature 14 moves under the influence of its own coupler 16. The couplers are mounted in a rotor 18. Each coupler 16 in this case is a set of three magnets. The rotor 18 has an upstanding post 20 on which a knob 22 is mounted for manipulating the rotor. The rotor is mounted for rotation on the carrier 12 by a bracket 24. Located just above the rotor 18 is a detent plate 26. The plate 26 is made of magnetic material and has a series of ribs. Each rib defines a detent position as it aligns with the coupler magnets 16. The plate 26 is held fixed by the bracket 24. As the knob rotates the coupler into alignment with a rib the magnetic attraction between the coupler and rib creates a tactile sensation to the user.

An armature retainer is shown generally at 28. It surrounds the armatures 14 on at least two sides. The armature retainer 28 is movably mounted to the underside of the carrier 12 by magnetic attraction to the coupler magnets 16. The armature retainer 28 includes a polishing pad 30, a web or backing layer 32, a debris collector or particle receiving groove 34 and a pivot hole 36. The polishing pad 30 and the backing layer 32 are laminated together with adhesive or other suitable means. The polishing pad 30 is adjacent the surface of the carrier 12 which has electrodes disposed thereon. The polishing pad 30 contains one or more openings or pockets 38 appropriately sized for the armature 14 to reside therein. In this embodiment the pockets 38 define a bore through the retainer thickness. The pockets 38 maintain the armature adjacent the carrier surface 12. The polishing pad 30 is made of fish paper. Other possible materials for the polishing pad could be wool, cotton, paper, felt, fur, cellulose fibers or any other material which has cleaning or polishing properties. During each use of the switch, the polishing pad 30 wipes the carrier surface 12, the electrodes and the ball armature 14. Continued use of the switch cleans and polishes the internal switch surfaces.

On the surface of the polishing pad 30 opposite the carrier 12 is the backing layer 32. The backing layer 32 is made of electrically non-conductive, magnetic material and is attracted to the coupler magnets 16 located within the rotor 18 such that the backing layer and the coupler magnets form a magnetic engagement. The backing layer 32 is preferably made of a material sold by Arnold Engineering Company of Marengo, Ill. under their trademark Ferro-Sheet. The magnetic engagement between the backing layer and the coupler magnets will remain even if the switch is subjected to high forces.

The debris collector 34 is an uptake for particles on the surface of the carrier. Although two oval-shaped debris collectors are shown, it will be realized that any number and shape of collectors are possible, including but not limited to circles, rectangles, triangles or other polygons. If the polishing pad 30 cannot remove a particle that rests on the carrier surface, the debris collector 34 will remove them, preventing any interference with the electrode contacts. With continued use of the switch, the debris collector will continue to remove particles from the carrier surface and electrodes. Thus, the switch will continue to perform reliably.

During actuation of the switch, both the armature and the armature retainer rotate. The coupler magnets cause rotation of the armature. Rotation of the armature retainer may occur due to forces exerted on the retainer by the rotating armature and/or by the magnetic attraction between the armature retainer and the coupler magnets within the rotor as the rotor is turned. So the retainer allows normal armature movement when the armature is magnetically engaged with the coupler magnets.

Figure 4:
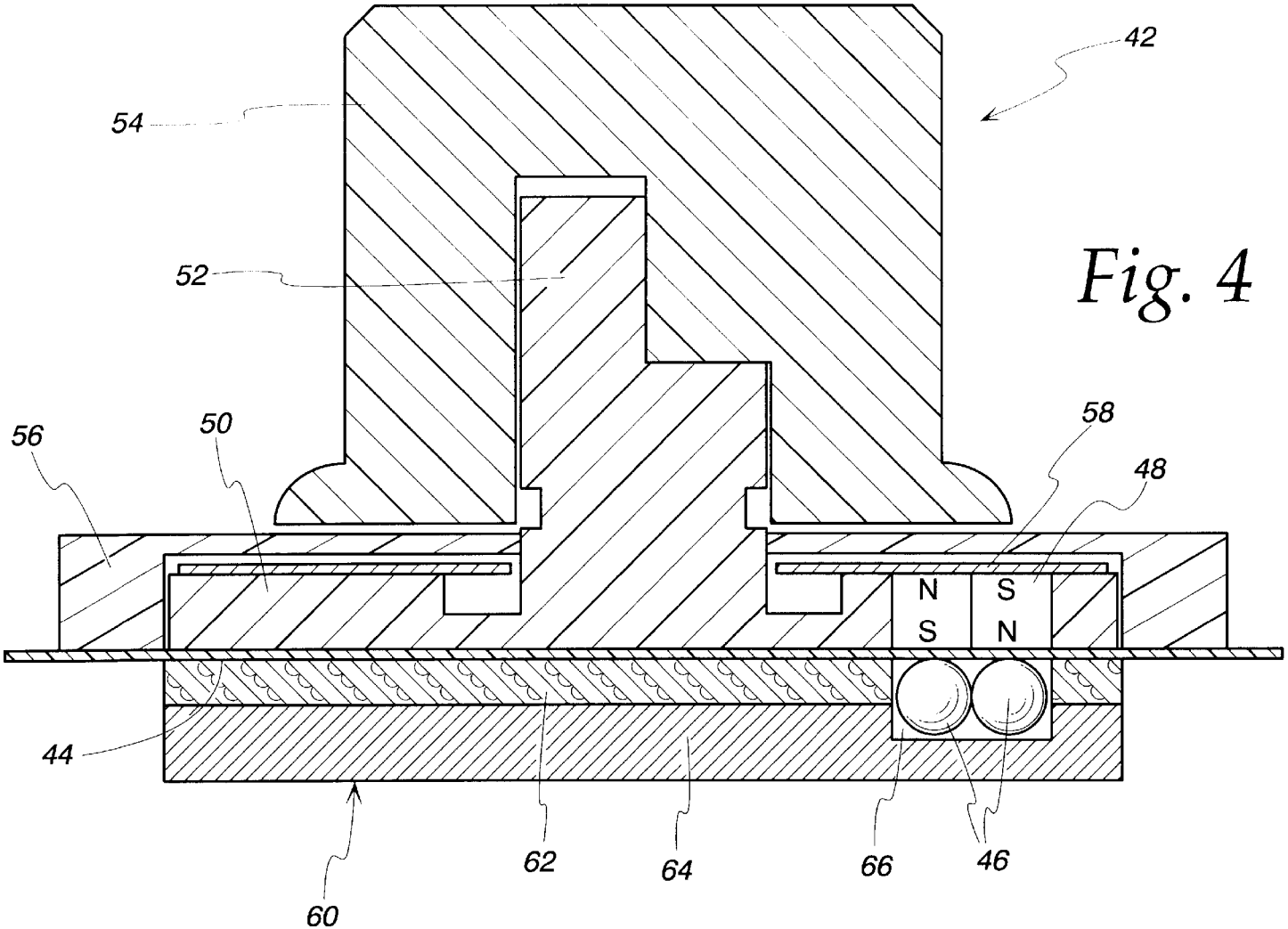
FIG. 4 is a section through a rotary switch with an alternate armature retainer.

FIG. 4 shows a rotary switch 42 similar to that shown in FIG. 1 but with a twinball armature and an alternate armature retainer. The rotary switch includes a carrier 44, an armature 46, coupler magnets 48, a rotor 50, a post 52, a knob 54, a bracket 56, a detent plate 58, an armature retainer 60, a polishing pad 62, a backing layer 64 and pockets 66. In this embodiment the pockets 66 terminate within the body of the retainer and the remaining backing layer thickness forms a cover to prevent the armature from falling out of the pocket.

Figure 5:
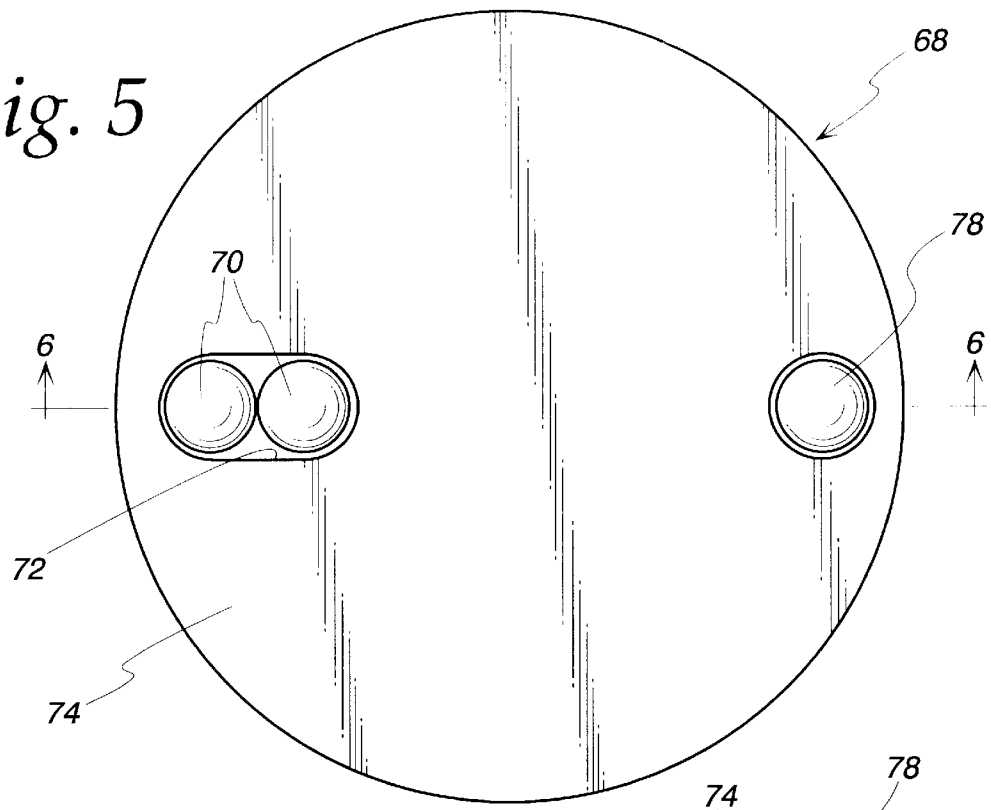
FIG. 5 is a plan view of another embodiment of an armature retainer.
Figure 7:
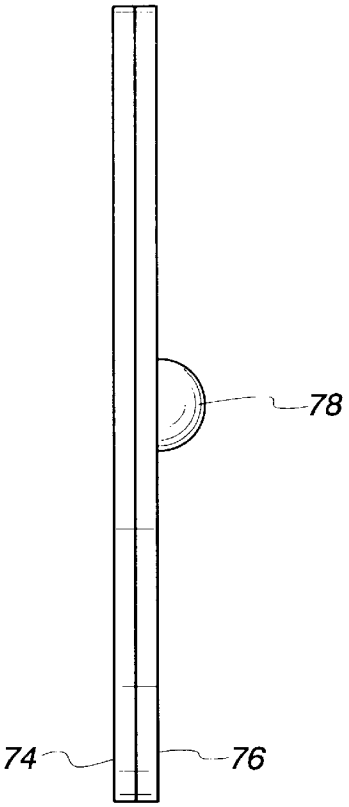
FIG. 7 is a right side view of the armature retainer in FIG. 5.
Figure 6:
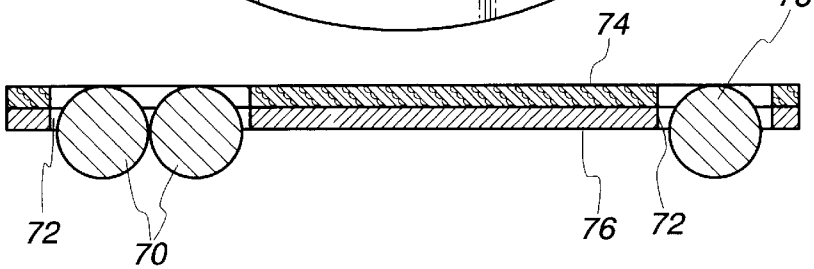
FIG. 6 is a section taken along line 6—6 of FIG. 5.

FIGS. 5, 6 and 7 show a further alternate armature retainer 68 with a twin-ball armature 70. Here, as in FIG. 1, the pockets 72 penetrate both a polishing pad 74 and a backing layer 76. As such, the pockets 72 are defined by a bore through the entire thickness of the retainer 68. A counter balance ball 78 positioned in a pocket 72 opposite the ball armature 70 may be used to provide torsion balance for the armature retainer 68 and the armature 70..

Figure 10:
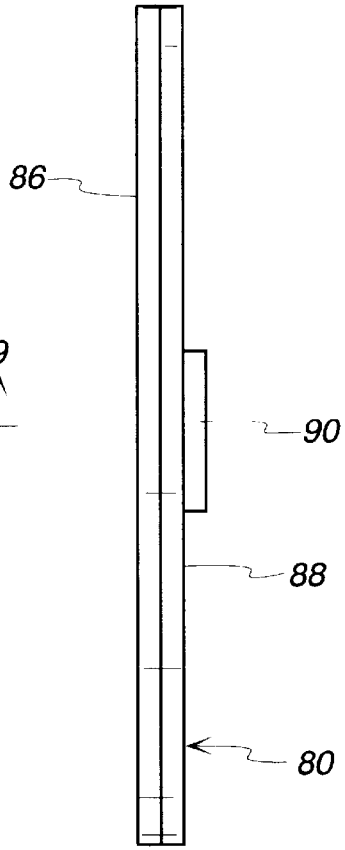
FIG. 10 is a right side view of an armature retainer in FIG. 8.
Figure 8:
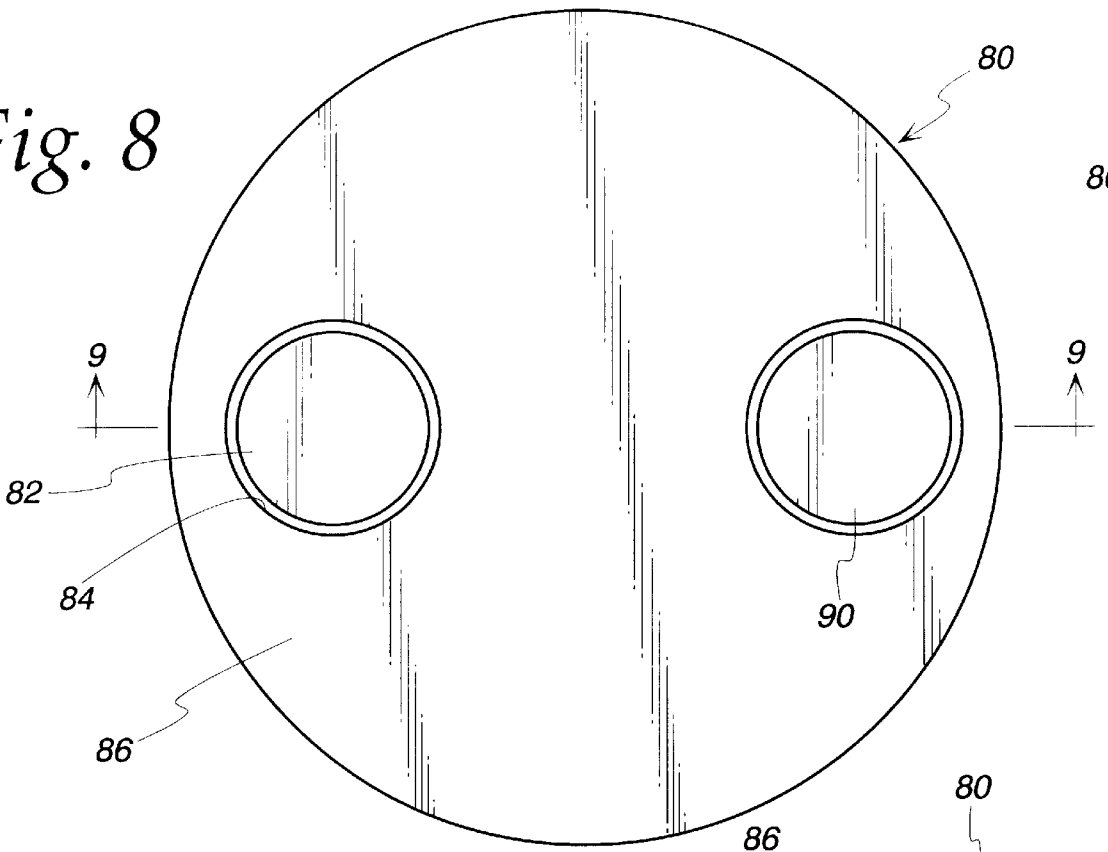
FIG. 8 is a plan view of an armature retainer with a disc-shaped armature.
Figure 9:
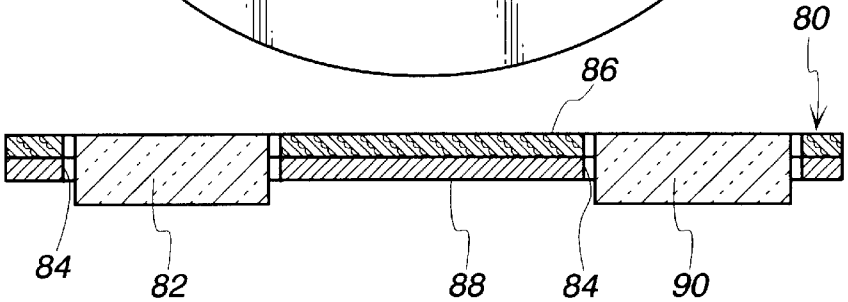
FIG. 9 is a section taken along line 9—9 of FIG. 8.

FIGS. 8, 9 and 10 show an armature retainer 80 that is similar to that in FIGS. 5, 6 and 7 except the switch has an alternate, disc-shaped armature 82. The disc-shaped armature 82 resides in one or more pockets 84 which penetrate a polishing pad 86 and a backing layer 88. Opposite the disc-shaped armature 82 is a counter balance 90. Although one disc armature is 10,; shown, any number of disc armatures may be used. As described above, the retainer rotates with the armature as the knob is turned.

Figure 13:
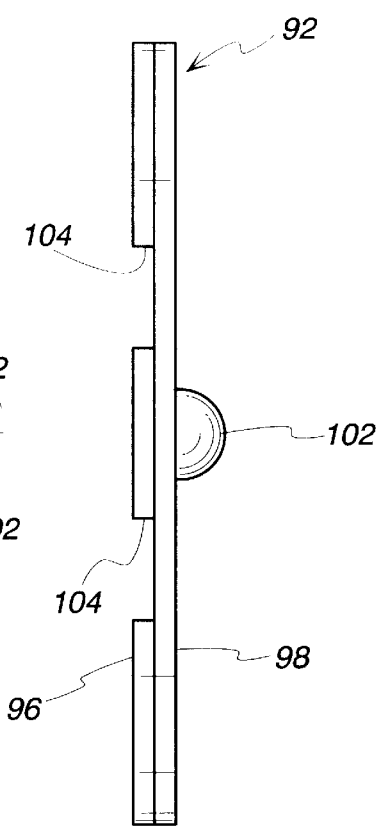
FIG. 13 is a right side view of the armature retainer in FIG. 11.
Figure 11:
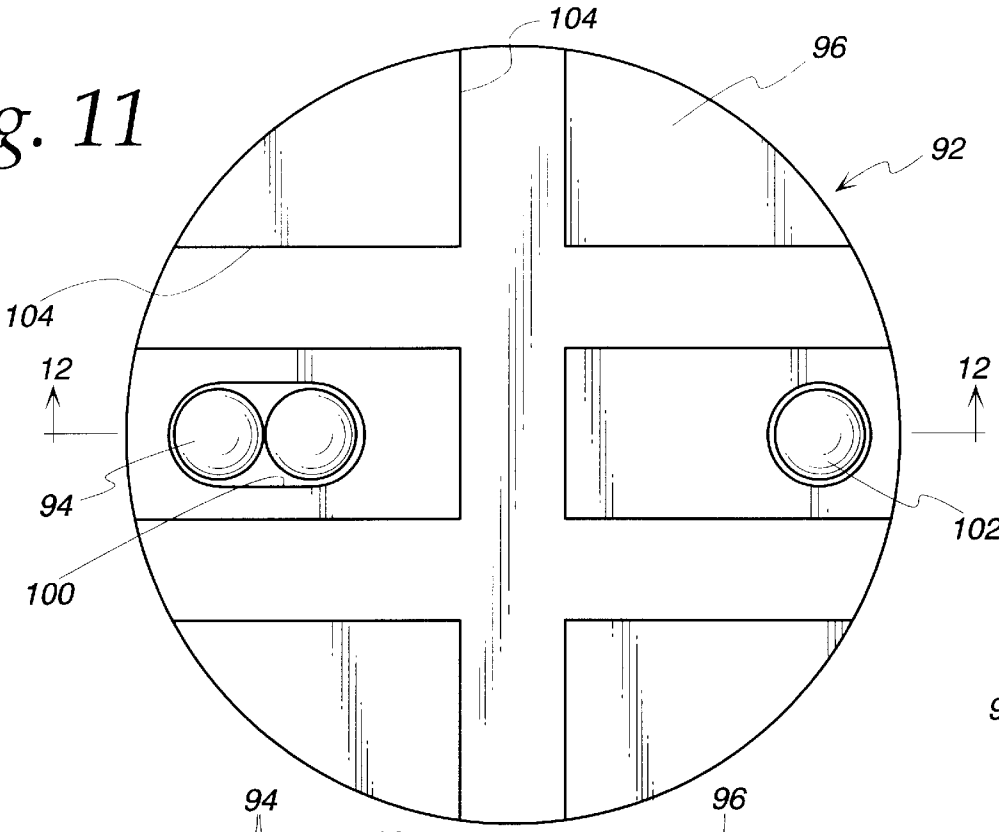
FIG. 11 is a plan view of an alternate armature retainer.
Figure 12:
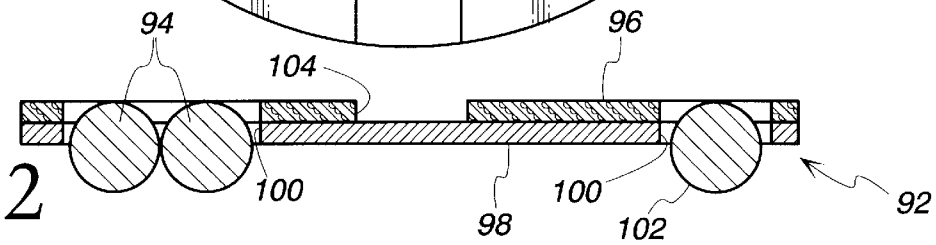
FIG. 12 is a section taken along line 12—12 of FIG. 11.

FIGS. 11, 12 and 13 similarly show an armature retainer 92 with an armature 94, a polishing pad 96, a backing layer 98, pockets 100 and counter balance ball 102. The retainer 92 also has a configuration of collectors or grooves 104 within the polishing pad 96. Each groove 104 will define edges of a channel for collecting particles. The channel defined by the groove may be rectangular, square, triangular, trapezoidal or other polygonal shape in cross section. The channels collect larger particles which may form on the carrier surface. If large particles rest on the carrier surface and cannot be removed by the polishing pad, the channels will entrap the particles and prevent them from obscuring the electrode contacts. With continued use of the switch, the polishing pad and the channels will continue to remove particles from the carrier surface and electrodes. Thus, the switch will continue to perform reliably. Although the grooves are shown parallel and perpendicular to one another in FIG. 11, they may be oriented in any position, shape and angle with respect to each other. Possible orientations and positions include unidirectional, radial, chord-like or any combination thereof. Groove shapes may include but not be limited to rectangles, circles and ovals. The thickness of the grooves may also be varied. While FIGS. 12 and 13 show groove thickness equal to the polishing pad, other thicknesses are also possible. Slot or groove thickness may be less than or greater than the thickness of the polishing pad or may be defined by a bore through the retainer thickness.

Figure 14:
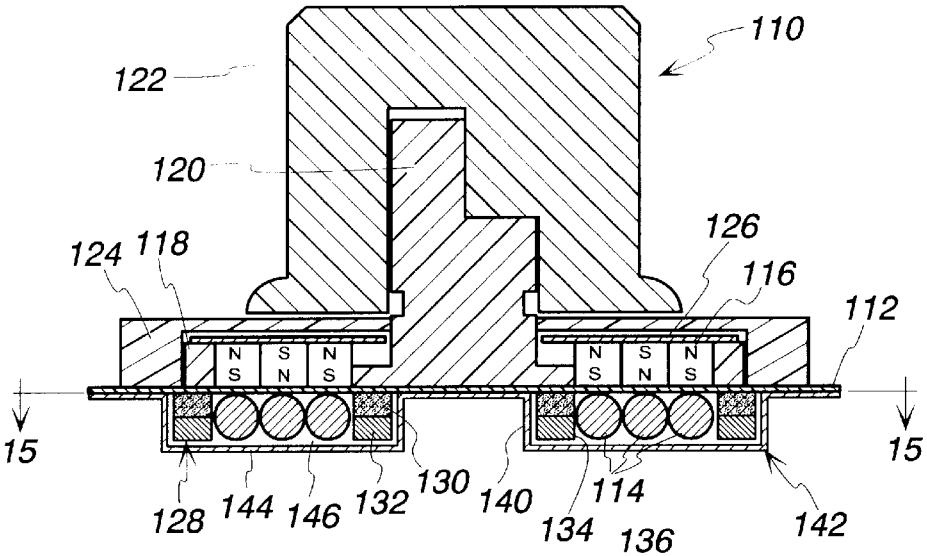
FIG. 14 is a section showing another embodiment of the present invention.
Figure 15:
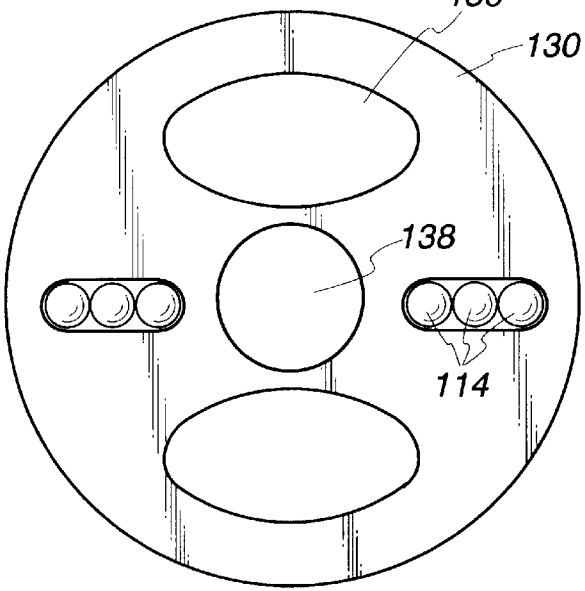
FIG. 15 is a plan view of the armature retainer along line 15—15 of FIG. 14.

FIGS. 14 and 15 show a rotary switch 110 similar to that shown in FIG. 1 including a carrier 112, an armature 114, coupler magnets 116, a rotor 118, a post 120, a knob 122, a bracket 124, a detent plate 126, an armature retainer 128, a polishing pad 130, a backing layer 132, pockets 134, a debris collector 136 and a pivot hole 138. The pivot hole 138 defines a shaft receiving opening which receives a shaft 140. The shaft 140 is an upright portion on a dome member, in this case a blister pack backer plate 142. The pivot hole 138 fits around the shaft 140 and tends to keep the armature retainer centered. Plate 142 is a film layer adhesively or otherwise secured to the underside of the carrier 112. Wherever a switch is located, a blister 144 is formed by embossing the film to provide a chamber 146 within which the armature 114 can float. Should the armature somehow become displaced, it is contained within the blister chamber 146 and thus the armature remains in the immediate vicinity of the magnets located in the rotor 118. The armature will be returned to its seated position either spontaneously after the dislodging force is removed, or when the rotor is again moved over the loose armature located inside the blister.

Whereas the preferred form of the invention has been shown and described herein, it should be realized that there may be many modifications, substitutions and alterations thereto. For example, the positions of the armature retainer and the magnets which attract it could be reversed. The armature retainer or some part thereof could be in the form of a magnet and the rotor could carry a piece of magnetic material. The magnetic material in the rotor would be attracted to the retainer. In addition to the coupler magnets, one or more magnets may be located in the rotor to provide a magnetic engagement with the armature retainer. The number and orientation of magnets engaging the retainer will depend upon the desired degree of magnetic strength. The magnetic engagement between the backing layer and the magnets will remain even if the switch is subjected to high forces.

It is apparent that any number of armatures may be used in any configuration. For example, although two and three ball armatures are described, one or more armatures may be used having any number of multiple balls. The retainer pockets will correspond to the number and size of armatures used. It is to be noted that additional magnets may need to be added with multi-ball armatures. Further, the pockets may be sized to accommodate multi-ball armatures in different orientations. Such orientations include but are not limited to linear, triangular or other closely packed structures. Other orientations will be apparent to one skilled in the art. It is also possible that one or more pockets may contain a ball armature and a counter balance where the number of balls and the number of counter balances are in any combination.

Where the armature pocket defines a bore through the retainer thickness, a cover layer may be attached to the outer surface of the armature retainer providing an enclosed pocket to further constrain armature movement. Where the retainer or some portion thereof forms a magnet, the cover layer will be made of a non-magnetically attractive material so that neither cover will interfere with the magnetic attraction between the armature and the coupler magnet.

Cleaning of the electrodes may also be accomplished by adding a lubricant to the carrier surface. The lubricant assists the polishing pad to clean and collect the particles, dust and debris. When used in combination with the grooves, lubrication will also clean larger particles from the carrier surface.

The thickness of the polishing pad can be used to control attractive force. It will also be realized that the retainer may be comprised solely of a backing layer with no polishing pad. For instance, the armature retainer may be made up entirely of an electrically non-conductive magnetically attracted material where no lamination is required.

What is claimed is:

1. An electrical switch, comprising:

a carrier having first and second surfaces;

a set of electrodes disposed on one of said carrier surfaces and defining at least one set of electrodes;

an actuator comprising an electrically conductive armature disposed on said one of the carrier surfaces, and a coupler movably mounted on the other of the carrier surfaces, one of the coupler and armature being a permanent magnet and the other being made of magnetic material such that the armature is normally held in engagement with said one surface of the carrier by the magnetic attraction between the coupler and armature, movement of the coupler causing corresponding movement of the armature relative to the electrodes; and an armature retainer for holding the armature adjacent said one of the carrier surfaces, the armature retainer being movably mounted on said one of the carrier surfaces and magnetically attracted to the coupler.

2. The switch of claim 1 wherein the armature retainer includes one or more openings therein for receiving the armature.

3. The switch of claim 2 wherein the openings receive a counter balance opposite the armature.

4. The switch of claim 2 wherein said openings are defined by a bore through the armature retainer.

5. The switch of claim 1 wherein the armature retainer further comprises a cover layer mounted on the surface of the armature retainer opposite the carrier.

6. The switch of claim 1 wherein the armature is two or more balls.

7. The switch of claim 1 wherein the armature is a disk.

8. The switch of claim 1 further comprising a lubricating material which is applied to the armature retainer.

9. The switch of claim 1 wherein a plurality of particle receiving grooves are disposed within the surface of the armature retainer for collecting particles.

10. The switch of claim 9 wherein the grooves are defined by a bore through the armature retainer.

11. The switch of claim 1 further comprising a shaft receiving opening for tending to keep the retainer centered.

12. The switch of claim 11 wherein the shaft receiving opening receives an upright portion of a dome member, said dome member defining a chamber in which the armature resides.

13. An electrical switch, comprising:

a carrier having first and second surfaces;

a set of electrodes disposed on one of said carrier surfaces and defining at least one set of electrodes;

an actuator comprising an electrically conductive armature disposed on said one of the carrier surfaces, and a coupler movably mounted on the other of the carrier surfaces, one of the coupler and armature being a permanent magnet and the other being made of magnetic material such that the armature is normally held in engagement with said one surface of the carrier by the magnetic attraction between the coupler and armature, movement of the coupler causing corresponding movement of the armature relative to the electrodes; and an armature retainer for holding the armature adjacent said one of the carrier surfaces, the armature retainer being movably mounted on said one of the carrier surfaces and comprising a polishing pad and a backing layer, said polishing pad being disposed adjacent said one of the carrier surfaces for cleaning the carrier surface, said backing layer being disposed adjacent the polishing pad opposite the carrier.

14. The electrical switch of claim 13 further characterized in that one of the armature retainer and the coupler is a permanent magnet and the other is made of magnetic material such that the armature retainer is normally held in engagement with said one surface of the carrier by magnetic attraction between the armature retainer and the coupler.

15. The electrical switch of claim 13 wherein the backing layer and polishing pad are laminated to one another.

16. The switch of claim 13 wherein a plurality of particle receiving grooves are disposed within the surface of the armature retainer for collecting particles.

* * * * *